United States Patent [19]

Kakizaki

[11] Patent Number: 4,571,212

[45] Date of Patent: Feb. 18, 1986

[54] SPARK EMITTING FLY WHEEL DRIVEN VEHICLE

[75] Inventor: Katsumi Kakizaki, Tokyo, Japan

[73] Assignee: Tomy Company, Incorporated, Japan

[21] Appl. No.: 609,983

[22] Filed: May 14, 1984

[51] Int. Cl.[4] ..... A63H 29/02

[52] U.S. Cl. ..... 446/462; 446/23; 446/448; 446/414

[58] Field of Search ..... 446/22, 23, 435, 440, 446/441, 448, 449, 450, 457, 462, 465, 163, 270, 271, 409, 413, 417, 418, 414

[56] References Cited

U.S. PATENT DOCUMENTS

| | | | |
|---|---|---|---|
| 1,210,666 | 1/1917 | Matthews | 446/22 |
| 2,055,848 | 9/1936 | Marx | 446/23 |
| 2,167,249 | 7/1939 | McKeige | 446/23 |
| 3,229,414 | 1/1966 | Bross | 446/163 |
| 4,363,186 | 12/1982 | Goldfarb et al. | 446/440 |
| 4,373,290 | 2/1983 | Goldfarb et al. | 446/462 |
| 4,394,037 | 7/1983 | Kuntz | 446/23 |
| 4,443,967 | 4/1984 | Jones et al. | 446/462 |

*Primary Examiner*—Robert A. Hafer
*Assistant Examiner*—Daniel Nolan
*Attorney, Agent, or Firm*—K. H. Boswell

[57] ABSTRACT

A toy vehicle is supported on one end by at least one wheel and on the other end by a fly wheel which is capable of being energized by pulling a gear rack across a pinion which is connected to the fly wheel. On one of the side surfaces of the fly wheel, a material is located which, when contacted by a flint, is capable of emitting sparks. A flint holding member is positioned adjacent to the fly wheel with a flint located on the flint holding member so as to contact the material on the side of the fly wheel. In conjunction with rotation of the fly wheel, sparks are emitted from contact of the flint with the material. Thus, as the car is propelled across a support surface by the fly wheel a trail of sparks are given off.

4 Claims, 3 Drawing Figures

SPARK EMITTING FLY WHEEL DRIVEN VEHICLE

BACKGROUND OF THE INVENTION

This invention is directed to a toy vehicle which is powered by energy stored in a fly wheel with the vehicle directly driven by contact of the fly wheel against a support surface and further including a material located on the fly wheel such that when the fly wheel is rotated and is contacted by a flint sparks, are emitted from the surface of the fly wheel.

A multiple of toy wheeled vehicles are known. These vehicles move in a number of different ways from simply those which coast when pushed, to those which include exotic motors and the like. One of the simpler types of vehicle propulsion means is the inclusion of a fly wheel within the vehicle.

With the advent of strong flexible plastic materials, flexible gear racks can be molded which can be utilized to energize a fly wheel by pulling the gear rack across a pinion attached to he fly wheel. Insofar as this type of vehicle does not require batteries or other costly expendable energy sources, they provide for endless hours of enjoyment by the users of the same.

A production of a spark by striking of a flint against an iron bearing material dates back to antiquity. At one time, certain toys were very popular which utilized this principle to produce short lived sparks much like those emitted from a common cigarette lighter. Unfortunately, in order to produce sparks from these toys, the user of the toy had to continuously energize the toy, such as pulling the trigger on a toy spark gun or the like. This detracted from the play value of these toys.

BRIEF DESCRIPTION OF THE INVENTION

In view of the above, it is considered that there exists a need for further toy vehicles which are capable of being propelled utilizing a non-expendable energy source, such as a fly wheel which can be energized by movement of a gear rack across a gear associated with the fly wheel. It is an object of this invention to provide a toy vehicle which is energized via the utilization of a fly wheel but is also capable of emitting sparks in combination in movement of the fly wheel. Additionally it is an object of this invention to provide a toy vehicle which is simple in construction and operation and thus will provide for extended play time of the vehicle and a long and useful life of the same.

These and other objects as will become evident from the remainder of this specification are achieved in a toy vehicle which comprises: a chassis having a first end and a second end; at least one wheel rotatably mounted proximal to said first end of said chassis for rollably supporting said first end of said chassis; a fly wheel mounted about a fly wheel axle proximal to said second end of said chassis, said fly wheel at least partially supporting said second end of said chassis; a pinion gear rotatably mounted about said fly wheel axle and operatively connected to said fly wheel such that rotation of said pinion gear rotates said fly wheel; a guide channel located on said chassis in association with said pinion gear, said guide channel for receiving a gear rack member and locating said gear rack member in mesh with said pinion gear whereby said fly wheel can be energized by rotating said fly wheel by said pinion gear by movement of said gear rack within said guide channel to rotate said pinion gear; a material located in a pattern around one side of said fly wheel, said material capable of interacting with a flint so as to produce sparks; a flint holding member attaching to said chassis in association with said fly wheel; a flint positioned on said flint holding member in a location so as to contact said material on said fly wheel as said fly wheel rotated so as to produce sparks in conjunction with rotation of said fly wheel.

In the illustrative embodiment of the invention the flint holding member is pivotably mounted to the chassis and further includes a biasing means associated with it so as to continually bias the flint against the material on the fly wheel in order to insure contact of the flint against the material on the fly wheel. This is provided by including a flint holding member axle on which the flint holding member is mounted so as to allow pivoting of the flint holding member on the axle under the influence of the biasing means. Preferredly, the axis of rotation of the flint holding member about the flint holding member axle is orthogonal with respect to the axis of rotation of the fly wheel about the fly wheel axle.

In the illustrative embodiment, a pair of first end wheels are mounted to the chassis of the vehicle so as to provide for support of the chassis in a triangular manner between the pair of first end wheels and the fly wheel. Further, a pair of second end wheels can be rotatably mounted outboard of the fly wheel, with one of these on one side of the fly wheel and the other on the other side of the fly wheel. In the illustrative embodiment, these second end wheels are located in a raised position on the chassis, such that when the chassis is on a level surface, the second end of the chassis is supported by the fly wheel but if the chassis tips to one side or the other, one or the other of the second ends will contact the support surface, allowing the chassis to roll on the second end wheel which contacts the support surface.

BRIEF DESCRIPTION OF THE DRAWINGS

This invention will be better understood when taken in conjunction with the drawings wherein.

Figure 1:
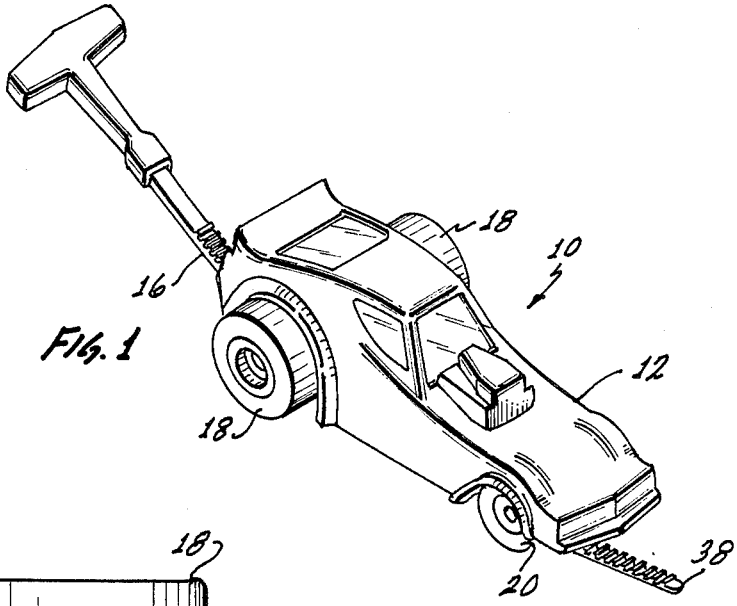
FIG. 1 shows an isometric view of a toy vehicle embodying the concept of this invention shown in conjunction with a flexible gear rack which is utilized to energize the toy vehicle.
Figure 2:
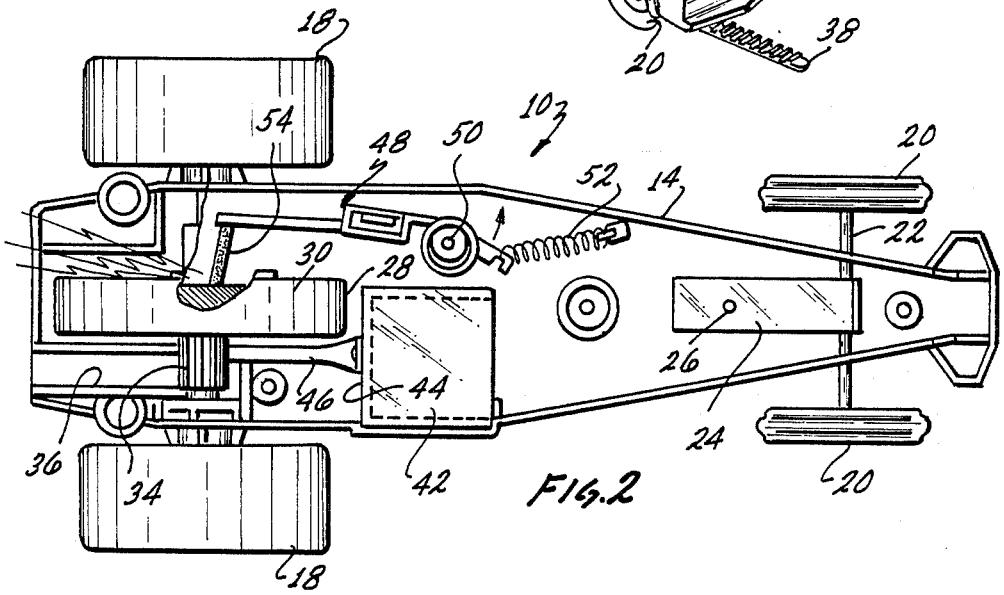
FIG. 2 is a top plan view in partial section of the inside of the toy shown in FIG. 1.

This invention utilizes certain principles and/or concepts which are set forth in the claims appended to this specification. Those skilled in the toy arts will realize that these principles and/or concepts are capable of being utilized in a variety of embodiments which may differ from the exact embodiment utilized for illustrative purposes herein. For this reason, this invention is not to be construed as being limited solely to the illustrative embodiment, but is only to be construed as being limited in view of the claims.

DETAILED DESCRIPTION OF THE INVENTION

In the FIGS., there is shown a toy wheeled vehicle 10. It has an outer body shell 12 which is constructed so as to mimic a drag strip type race car. The body shell 12 fits over a chassis member 14. To activate the vehicle 10, a flexible gear rack 16 is inserted into a channel in the rear end of the body shell 12 as hereinafter explained, and the gear rack 16 is rapidly pulled away from the vehicle 10 so as to energize a fly wheel, hereinafter identified, within the vehicle 10.

Upon energizing the fly wheel, the vehicle 10 emits sparks near the vicinity of the rear wheels 18 and if the vehicle 10 is set on a support surface the vehicle 10 will travel across the support surface while emitting sparks from the rear of the vehicle as it travels, much in a manner mimicking the performance of an actual drag strip type race car.

The rear wheels 18 are each independently rotatably mounted to the chassis 14 so as to be able to spin on the chassis 14. In addition to the rear wheels 18 there are two front wheels collectively identified by the numeral 20 each of which is mounted to a front axle 22. The front axle 22 is held in the chassis 14 by a spring 24 which is attached via a rivet 26 to the chassis 14. The spring 24 allows for suspension type movement of the front axle 22 in order to allow the front wheels 20 to pivot up and down.

The front end of the chassis member 14 is supported by the two front wheels 20. The rear end of the chassis member 14 is supported by the outside surface 28 of a fly wheel 30. The combination of the fly wheel 30 and the two front wheels 20 provide for a triangular type support for the vehicle 10 on a support surface. If, during movement of the vehicle 10 across a support surface, the vehicle veers such that it is no longer level, with one side or the other being depressed, the rear wheel 18 located on that side then contacting the support surface to support the vehicle in combination with one of the front wheels 20. Normally, however, because of the mass of the fly wheel 30 and the gyroscopic effect achieved upon rapid rotation of the same, the vehicle 10 will travel across the support surface on the front wheels 20 and the fly wheel 30.

The fly wheel 30 freely rotates on a fly wheel axle 32 which is supported on the chassis member 14. Formed as a portion of the fly wheel 30 and extending out of one side of the fly wheel 30 is a pinion gear 34. The pinion gear 34 is engaged by the gear rack 16 to energize the fly wheel 30.

Figure 3:
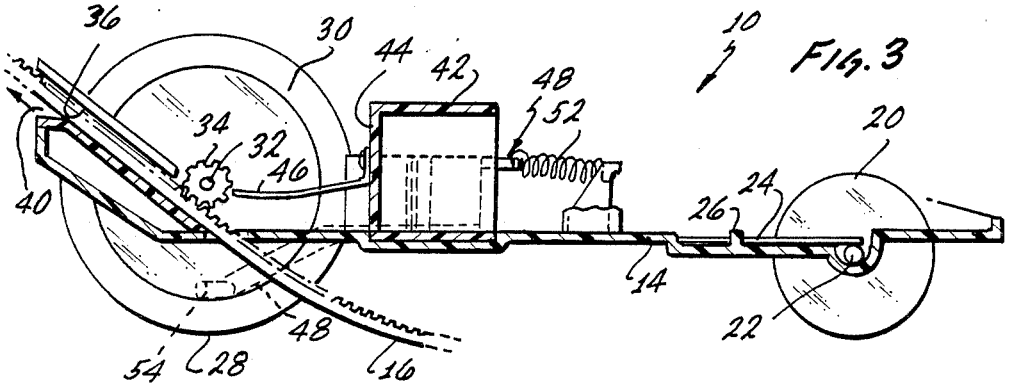
FIG. 3 is an elevational view in section of FIG. 2.

A channel 36 is formed in the chassis member 14 so as to provide a guide to position the gear rack 16 in engagement with the pinion 34. The end 38 of the gear rack 16 is inserted into the opening 40 of the channel 36 until it engages the pinion gear 34. The gear rack 16 is pushed into the channel 36 which slowly rotates the fly wheel 30 in a counterclockwise manner as seen in FIG. 3. When the gear rack 16 is fully inserted within the channel 36 it is then rapidly pulled out of the channel 36 to energize the fly wheel 30 such that it rotates in a clockwise direction as seen in FIG. 3. Since the fly wheel 30 and the pinion 32 are freely mounted upon the fly wheel axle 32 after all momentum associated with energizing of the fly wheel 30 has been lost, the momentum then imparted to the vehicle 10 by the flywheel 30 will continue to propel the vehicle 10 forward with the fly wheel 30 free wheeling about the fly wheel axle 32 until all momentum of the vehicle 10 is lost, and at such time the vehicle 10 will come to rest.

Located on the chassis member 14 is a sound chamber 42 which is open at one end and includes a back plate 44 on the other end. Attaching to the back plate 44 is a sound pick up member 46. The pick up member 46 is made from a stiff "spring-like" type material, with one of its ends, as noted above, attaching to the back plate 44 and the other of its end engaging the pinion gear 34. As the pinion gear 34 rotates, it vibrates the sound pick up memeber 46 with the vibration transferred to the sound chamber 42 to produce a sound within the vehicle 10 in conjunction with rotation of the fly wheel 30.

A flint holding member 48 formed as a first class lever is mounted about a flint holding member axle 50 which is supported within the chassis member 14. A small spring 52 is attached to one of the ends of the flint holding member 48 and attached at its other end to the chassis member 14. This biases the flint holding member 48 so as to pivot it about the axle 50. A flint 54 is attached to he other end of the flint holding member 48. The spring 52 biases the flint holding member 48 such that the flint 54 contacts one side of the fly wheel 30. A material capable of interacting with the flint 54 is adhered to the side of the fly wheel 30 which contacts the flint 54 such that upon rotation of the fly wheel 30 sparks are emitted as a result of the friction generated between the flint 54 and the material located on the side of the fly wheel. Typically, this will be an iron based material adhered to the side of the fly wheel 30 utilizing a typical adhesive or the like. In any event, upon rotation of the fly wheel 30, sparks are emitted out of the rear end of the vehicle 10 in combination with motion of the vehicle 10 across the support surface under the energy stored within the fly wheel 30.

I claim:

1. A toy vehicle which comprises:

a chassis having a first end and a second end;

at least one wheel rotatably mounted proximal to said first end of said chassis for rollably supporting said first end of said chassis;

a flywheel mounted about a flywheel axle proximal to said second end of said chassis, said flywheel at least partially supporting said second end of said chassis;

a pinion gear rotatably mounted about said axle and operatively connected to said flywheel such that rotation of said pinion gear rotates said flywheel;

a guide channel located on said chassis in association with said pinion gear, said guide channel for receiving a gear rack member and locating said gear rack member in mesh with said pinion gear whereby said flywheel can be energized by rotation of said flywheel by said pinion gear by movement of said gear rack within said guide channel to rotate said pinion gear;

a material located in a pattern around one side of said flywheel, said material capable of interacting with a flint so as to produce sparks;

a flint holding member axle located on said chassis;

a flint holding member pivotally mounted to said chassis by said flint holding member axle, the axis of rotation of said flint holding member about said flint holding member axle being orthogonal with respect to the axis of rotation of said flywheel about said flywheel axle;

a flint positioned on said flint holding member in a location so as to contact said material on said flywheel;

a biasing means associated with said flint holding member, said biasing means biasing said flint holding member in a direction so as to bias said flint against said material on said flywheel whereby, as said flywheel rotates, said flint is in contact with said flywheel and produces sparks in conjunction with said rotation of said flywheel;

a sound means located on said chassis in operative association with said pinion, said sound means includes a resonator chamber and a pick up member, said pick up member attaching to said resonator chamber and projecting from said resonator chamber toward said pinion so as to contact said pinion, said pinion vibrating said pick up member in response to rotation of said pinion.

2. The toy of claim 1 wherein:

said flint holding member comprises a first class lever having said flint located at one end of said lever and said biasing means attaching between the other end of said lever and said chassis.

3. The toy of claim 2 wherein:

a pair of second end wheels, one of said second end wheels rotatably mounted to said chassis outboard of said fly wheel on one side of said fly wheel and the other of said second end wheels rotatably mounted to said chassis outboard of said fly wheel on the other side of said fly wheel.

4. The toy of claim 3 including:

two first end wheels rotatably mounted on said chassis by a first end axle whereby when said vehicle is in a level position on a support surface said vehicle is supported on said support surface by said two first end wheels and said fly wheel.

* * * * *

UNITED STATES PATENT AND TRADEMARK OFFICE

CERTIFICATE OF CORRECTION

PATENT NO. : 4,571,212

DATED : FEBRUARY 18, 1986

INVENTOR(S) : KATSUMI KAKIZAKI

It is certified that error appears in the above-identified patent and that said Letters Patent is hereby corrected as shown below:

Column 1, Line 11, insert the punctuation "," after the word flint, and delete the --,-- after the word sparks.

Column 1, line 22, "he" should be --the--.

Column 2, line 6, "rotated" should be --rotates--.

Column 2, line 35, delete the letter "s" of the word "ends"; and further, after the corrected word "end", add the word --wheels--.

Column 3, line 53, "32" should be --34--.

Column 4, line 11, "he" should be --the--.

Signed and Sealed this

Seventh Day of October, 1986

[SEAL]

*Attest:*

DONALD J. QUIGG

*Attesting Officer*

*Commissioner of Patents and Trademarks*